US009003620B2

(12) United States Patent
Wang et al.

(10) Patent No.: US 9,003,620 B2
(45) Date of Patent: Apr. 14, 2015

(54) PROCESS FOR PRODUCING LIQUID EJECTION HEAD

(71) Applicant: Canon Kabushiki Kaisha, Tokyo (JP)

(72) Inventors: Shinan Wang, Kashiwa (JP); Toru Nakakubo, Kawasaki (JP); Hirotaka Sekiguchi, Fujisawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 162 days.

(21) Appl. No.: 13/915,901

(22) Filed: Jun. 12, 2013

(65) Prior Publication Data

US 2013/0340219 A1 Dec. 26, 2013

(30) Foreign Application Priority Data

Jun. 22, 2012 (JP) ..... 2012-140698

(51) Int. Cl.
*H04R 17/00* (2006.01)
*B41J 2/16* (2006.01)

(52) U.S. Cl.
CPC ..... *B41J 2/164* (2013.01); *B41J 2/1609* (2013.01); *B41J 2/1623* (2013.01); *B41J 2/1631* (2013.01); *B41J 2/1632* (2013.01); *B41J 2/1634* (2013.01); *B41J 2/1642* (2013.01); *B41J 2/1646* (2013.01)

(58) Field of Classification Search
CPC ..... B41J 2002/14491; B41J 2002/14217; B41J 2002/14225; B41J 2002/14306; B41J 2002/14362; B41J 2002/14379; B41J 2202/11; B41J 29/38; B41J 29/393; B41J 2/04521; B41J 2/04541; B41J 2/04545; B41J 2/04573; B41J 2/0458; B41J 2/04598; B41J 2/125; B41J 2/14072; B41J 2/14209; B41J 2/1433; B41J 2/16579; B41J 2/45
USPC ..... 29/25.35, 890.1; 347/54, 68–72
See application file for complete search history.

(56) References Cited

U.S. PATENT DOCUMENTS

| | | | | |
|---|---|---|---|---|
| 5,289,209 | A * | 2/1994 | Suzuki et al. | 347/71 |
| 5,622,611 | A * | 4/1997 | Marks et al. | 205/67 |
| 5,685,491 | A * | 11/1997 | Marks et al. | 239/533.12 |
| 6,174,051 | B1 * | 1/2001 | Sakaida | 347/72 |
| 7,156,505 | B2 * | 1/2007 | Suzuki | 347/72 |
| 7,591,544 | B2 * | 9/2009 | Shimada | 347/68 |
| 7,695,103 | B2 * | 4/2010 | Nagashima | 347/40 |
| 8,784,591 | B2 * | 7/2014 | Wang | 156/153 |
| 2002/0191055 | A1 * | 12/2002 | Shingai et al. | 347/70 |

FOREIGN PATENT DOCUMENTS

JP 2010-181813 A 8/2010

* cited by examiner

*Primary Examiner* — Paul D Kim
(74) *Attorney, Agent, or Firm* — Fitzpatrick, Cella, Harper & Scinto

(57) ABSTRACT

A process for producing a liquid ejection head having a piezoelectric body provided with an ejection orifice for ejecting liquid and a pressure chamber communicating therewith for retaining the liquid, wherein an electrode is formed on an inner wall surface of the pressure chamber to deform the pressure chamber by piezoelectric action caused by applying voltage to the electrode to eject the liquid, comprising providing the piezoelectric body in which a surface thereof having the ejection orifice has an arithmetic mean roughness of 0.1-1 μm, forming a dry film resist pattern on the surface of the piezoelectric body so as to expose the ejection orifice and a linear region connected thereto, and forming a metal thin film pattern being connected to the electrode on the inner wall surface and continuously extending from the inner wall surface to the linear region by using the dry film resist pattern as a mask.

6 Claims, 5 Drawing Sheets

PROCESS FOR PRODUCING LIQUID EJECTION HEAD

BACKGROUND OF THE INVENTION

1. Field of the Invention

The present invention relates to a process for producing a liquid ejection head provided with a piezoelectric body.

2. Description of the Related Art

A piezoelectric type ink jet head provided with a piezoelectric body containing a piezoelectric material such as PZT ($Pb(Zr, Ti)O_3$; lead zirconate titanate) is known. In the piezoelectric type ink jet head, a pressure chamber for applying an ejection pressure to an ink is formed, and an electrode electrically connected to a head substrate is provided on an inner wall surface and an outer wall surface of the pressure chamber. A voltage is applied to the electrode from the head substrate, whereby a side wall, a bottom wall and a top wall of the pressure chamber are deformed to change a capacity of the pressure chamber. An ejection pressure is thereby applied to an ink within the pressure chamber, and an ink droplet is ejected from an ejection orifice communicated with the pressure chamber.

In the production of the piezoelectric type ink jet head, a wiring electrode composed of a metal thin film may be formed on a lateral surface of the piezoelectric body, on which surface the ejection orifice of the pressure chamber is located, in some cases. In this case, it is difficult to form a pattern by an ordinary liquid resist on the lateral surface of the piezoelectric body because the ejection orifice is present, and so a dry film resist is suitably used. In order to prevent pattern defect (abnormality) such as release of the resist, it is important to ensure adhesion between the dry film resist and the piezoelectric body. It is thus conducted to remove air in a vacuum chamber and then bond the dry film resist to the surface of the piezoelectric body under pressure while being heated (vacuum lamination).

In the technology described in Japanese Patent Application Laid-Open No. 2010-181813, a further device is provided for the dry film resist. Specifically, in the dry film resist, a surface roughness Ra of a surface, coming into contact with a resist layer, of a protecting layer laminated on the resist layer (photosensitive resin layer) is controlled to more than 0.5 μm. Irregularities are applied to the protecting layer in this manner, whereby a bubble liable to remain at a contact surface between the protecting layer and the resist layer can be efficiently removed.

However, the dry film resist is relatively good in adhesion to a metal such as Cu or Al, but not very good in adhesion to a piezoelectric body such as PZT. The conventional vacuum lamination technology and the technology described in Japanese Patent Application Laid-Open No. 2010-181813 pay attention to the removal of the bubble and cannot sufficiently ensure adhesion between the dry film resist and the piezoelectric body. In particular, when a pattern is formed on the lateral surface of the piezoelectric body, on which surface the ejection orifice is located, with the dry film resist, pattern release may occur due to insufficient adhesion though the bubble can be sufficiently removed. In fact, when the dry film resist is vacuum-laminated on the ejection orifice of the piezoelectric body, the dry film resist may be pushed into the interior of the pressure chamber through the ejection orifice of the piezoelectric body in some cases. In order to remove the resist pushed into the interior of the pressure chamber by development, a longer development time is required compared with a resist present on a flat portion. However, if the development time is long, a resist portion (resist pattern) intended to remain is also released from the surface of the piezoelectric body to cause pattern defects. It is thus desired to more improve the adhesion between the dry film resist and the piezoelectric body.

SUMMARY OF THE INVENTION

It is an object of the present invention to provide a process capable of forming a metal thin film on a surface of a piezoelectric body, on which surface an ejection orifice is located, without causing pattern defects.

The process for producing a liquid ejection head according to the present invention is a process for producing a liquid ejection head having a piezoelectric body provided with an ejection orifice for ejecting a liquid and a pressure chamber communicating with the ejection orifice for retaining the liquid to be ejected from the ejection orifice, wherein an electrode is formed on an inner wall surface of the pressure chamber so that the pressure chamber is deformed by a piezoelectric action caused by applying a voltage to the electrode, thereby ejecting the liquid, the process comprising the steps of: providing the piezoelectric body in which a surface thereof on which the ejection orifice is located has a surface roughness within a range of 0.1 μm or more and 1 μm or less in terms of arithmetic mean roughness Ra, forming a pattern of a dry film resist on the surface of the piezoelectric body so as to expose the ejection orifice and a linear region connected to the ejection orifice, and forming a pattern of a metal thin film that is connected to the electrode on the inner wall surface and continuously extends from the inner wall surface to the linear region by using the pattern of the dry film resist as a mask.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

First Embodiment

A process for producing a liquid ejection head (ink jet head) according to a first embodiment will be described with reference to FIGS. 1A to 1H and FIGS. 2A to 2G. FIGS. 1A to 1H are sectional views, and FIGS. 2A to 2G are partial perspective views.

In this embodiment, a piezoelectric body in which a pressure chamber and an air chamber are two-dimensionally arranged is first provided by subjecting a piezoelectric substrate to treatments such as electrode formation, grooving and poling, and laminating plural sheets of the piezoelectric substrate subjected to the treatments as illustrated in FIGS. 1A to 1G. As illustrated in FIG. 1H and FIGS. 2A to 2G, a pattern of a metal thin film is then formed as a wiring electrode on a lateral surface of the piezoelectric body, said surface having openings of the pressure chamber and the air chamber as well as an interface between the piezoelectric substrates.

Figure 1A:
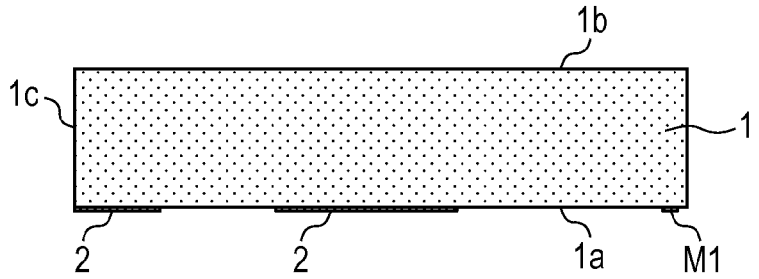
FIGS. 1A, 1B, 1C, 1D, 1E, 1F, 1G and 1H illustrate a process for producing a liquid ejection head according to a first embodiment.

A first piezoelectric substrate 1 is first provided as illustrated in FIG. 1A. Examples of the first piezoelectric substrate 1 include a PZT substrate of 50 mm×50 mm×0.25 mm.

A first mark M1 as an alignment mark is then formed on a first principal surface 1*a* of the first piezoelectric substrate 1. The first mark M1 can be formed by preparing a pattern on the first principal surface 1*a* of the first piezoelectric substrate 1 by mechanical machining or laser beam machining. A pattern of a metal film formed by a lift-off technique of a metal film including a photolithography process or an etching technique may also be provided as the first mark M1.

A first electrode 2 is then formed on the first principal surface 1*a*. The position of the first electrode 2 is determined on the basis of the first mark M1. Methods for forming the first electrode 2 include a lift-off technique of a metal film including steps of photolithography, metal film deposition and resist stripping. As a method for forming the metal film, a sputtering method or a chemical vapor deposition (CVD) method may be favorably utilized. After a thin seed film is formed on the piezoelectric substrate 1 by lift-off of a metal film, a relatively thick metal film may be formed by plating to provide the first electrode 2. In that case, examples of the seed layer include a two-layer film formed in the order of Cr and Pd, and examples of the relatively thick metal film include a two-layer film formed in the order of Ni and Au.

When the first mark M1 is formed from a pattern of a metal, the first electrode 2 is favorably formed by the same method as the method for forming the first mark M1 at the same time as the formation of the first mark M1. The first mark M1 and the first electrode 2 are formed at the same time, whereby the positions of the first electrode 2 to the first mark M1 can be determined with higher precision.

Figure 1B:
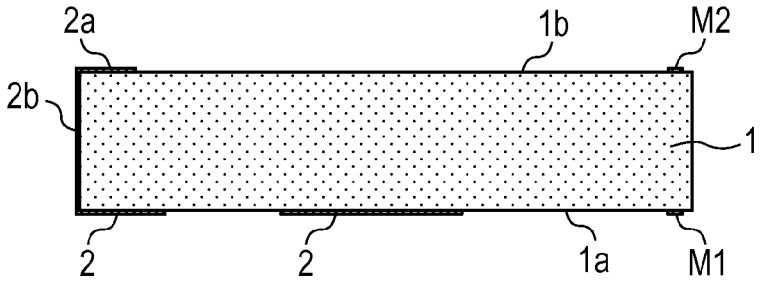

As illustrated in FIG. 1B, an electrode pad 2*a* is then formed on a second principal surface 1*b* of the first piezoelectric substrate 1. An electrode wiring 2*b* is formed on a surface of the first piezoelectric substrate 1 including a lateral surface 1*c* (see FIG. 1A) of the piezoelectric substrate 1 to electrically connect the first electrode 2 formed on the first principal surface 1*a* to the electrode pad 2*a*. In addition, a second mark M2 is formed on the second principal surface 1*b* at a position determined on the basis of the first mark M1 formed on the first principal surface 1*a*. The electrode wiring 2*b*, the electrode pad 2*a* and the second mark M2 are formed at the same time according to the following method.

First, a seed layer (not illustrated) for forming the electrode pad 2*a*, the electrode wiring 2*b* and the second mark M2 is formed on the first piezoelectric substrate 1 by a lift-off technique of a metal film including a photolithography process. More specifically, a Cr layer having a thickness of 20 nm and a Pd layer having a thickness of 150 nm are formed in this order on the second principal surface 1*b* and lateral surface 1*c* of the first piezoelectric substrate 1 by a sputtering method to provide the seed layer. Upon the sputtering, the piezoelectric substrate 1 is arranged in such a manner that the second principal surface 1*b* faces a target for sputtering. In this case, by utilizing the coatability of sputtering, the seed layer for the electrode wirings 2*b* can be formed on the lateral surface 1*c* (see FIG. 1A) of the first piezoelectric substrate 1 at the same time as the formation of the seed layer for forming the second mark M2 and electrode pad 2*a*.

The seed layer is then utilized to successively form thin Ni and Au films respectively having thicknesses of about 1 μm and about 0.1 μm by an electroless plating method, thereby providing the electrode pad 2*a*, the electrode wiring 2*b* and the second mark M2. The first electrode 2 formed on the first principal surface 1*a* of the first piezoelectric substrate 1 is thereby drawn out on the second principal surface 1*b* of the first piezoelectric substrate 1 through the electrode wiring 2*b* and the electrode pad 2*a*. In addition, the second mark M2 is formed on the basis of the first mark M1.

Figure 1C:
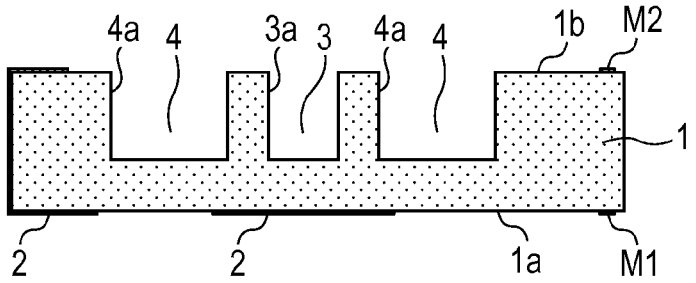

As illustrated in FIG. 1C, a first groove 3 forming a part of the inner wall surface of the pressure chamber and a second groove 4 forming a part of the inner wall surface of the air chamber are then alternately formed side by side in the second principal surface 1*b* of the first piezoelectric substrate 1 on the basis of the second mark M2 formed in the above-described manner. The position of the first electrode 2 is determined on the basis of the first mark M1, and the position of the second mark M2 is determined on the basis of the first mark M1. Accordingly, the positions of the first groove 3 and second groove 4 are determined on the basis of the second mark M2, whereby the position of the first groove 3 can correspond to the position of the first electrode 2.

Sizes of the first and second grooves 3 and 4 in a thickness-wise direction Y (hereinafter referred to as groove depths), sizes in a direction Z along which each groove extends, and sizes in a width-wise direction X (hereinafter referred to as groove widths) intersecting the direction Z along which each groove extends and the thickness-wise direction Y may respectively vary. Grinding by a super-abrasive wheel is favorable as a method for forming the first and second grooves 3 and 4. As an example, the first groove 3 and the second groove 4 may be arranged in parallel with one another at regular intervals with the sizes and arrangement periods (arrangement intervals) thereof made the same. For example, the first and second grooves 3 and 4 are grooves periodically arranged and each having a groove length (size in the direction Z) of 50 mm, a groove width of 0.1 mm and a groove depth of 0.15 mm with the grooves being formed at intervals of 0.212 mm between adjoining grooves.

Figure 1D:
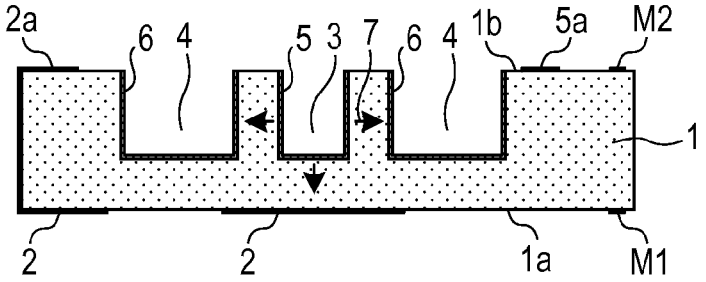

As illustrated in FIG. 1D, a second electrode 5 and an electrode pad 5*a* are then formed respectively on an inner wall surface 3*a* (see FIG. 1C) of the first groove 3 and the second principal surface 1*b* remaining after the grooves are formed. At the same time, a third electrode 6 is formed on an inner wall surface 4*a* (see FIG. 1C) of the second groove 4.

At the same time as the formation of the second electrode 5, a plurality of electrode wirings (not illustrated) are formed on the second principal surface 1*b*. Several electrodes 5 formed on the inner wall surface of the groove 3, of all second electrodes 5, are electrically connected to the electrode pad 5*a* with some of the plurality of the electrode wirings. Several electrodes 6 formed on the inner wall surface of the groove 4 adjoining the groove 3, of all third electrodes 6, are electrically connected to the electrode pad 2*a* with electrode wirings not connected to the electrodes 5 of the plurality of the electrode wirings. However, the electrode pad 2*a* and the electrode pad 5*a* are electrically separated from each other.

Methods for forming the second electrode 5, the electrode pad 5*a*, the third electrode 6 and the electrode wirings on the second principal surface 1*b* may be the same as the method for forming the first electrode 2 on the first principal surface 1*a* as described in FIG. 1A.

An electric field is then applied between the electrode pad 2*a* and the electrode pad 5*a* to conduct a poling treatment to the lateral and bottom walls of the first groove 3. The main direction of poling is a direction indicated by the arrow 7 in FIG. 1D. When the poling treatment is conducted, the electric field strength and the temperature are set according to the properties of a material of the first piezoelectric substrate 1. For example, the electric field strength is set to 1.5 kV/mm.

The poling treatment is conducted in such a state that the first piezoelectric substrate 1 has been heated as needed. For example, the electric field is applied in such a state that the first piezoelectric substrate 1 has been kept at 100° C. In order to prevent dielectric breakdown (creeping discharge) between electrodes due to the electric field when the first piezoelectric substrate 1 is subjected to the poling treatment, the poling treatment may also be conducted in such a state that the piezoelectric substrate 1 has been immersed in an insulating liquid (for example, silicone oil).

After the poling of the first piezoelectric substrate 1, an aging treatment is conducted as needed. Specifically, the first piezoelectric substrate 1 subjected to the poling treatment is held for a certain period of time in a state of being heated, thereby stabilizing the piezoelectric characteristics thereof. The aging treatment is conducted by, for example, leaving the first piezoelectric substrate 1 subjected to the poling treatment to stand for 10 hours in an oven of 100° C.

Figure 1E:
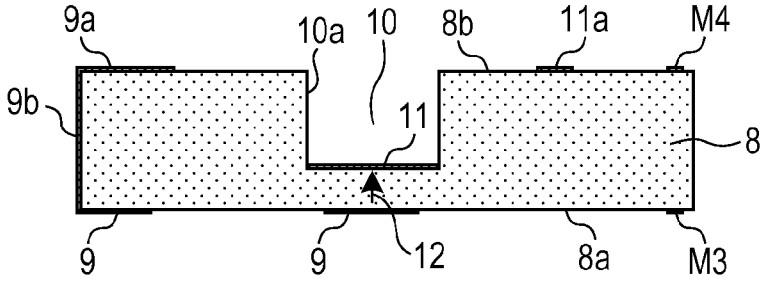

As illustrated in FIG. 1E, the following working is then conducted to a second piezoelectric substrate 8. Specifically, a third mark M3, a fourth mark M4, a fourth electrode 9, an electrode pad 9*a*, a third groove 10, a fifth electrode 11 and an electrode pad 11*a* are respectively formed to the second piezoelectric substrate 8. The third groove forms an inner wall surface of an air chamber, and a plurality of grooves are formed in parallel with one another. An electrode wiring (not illustrated) for connecting the fourth electrode 9 to the electrode pad 9*a* and an electrode wiring (not illustrated) for connecting the fifth electrode 11 to the electrode pad 11*a* are respectively formed on the second piezoelectric substrate 8. In addition, an electric field is applied between the electrode pad 9*a* and the electrode pad 11*a* to conduct a poling treatment to a bottom wall of the third groove 10. A main direction of poling of the second piezoelectric substrate 8 is a direction indicated by the arrow 12. In FIG. 1E, the fifth electrode 11 is formed only on the bottom wall of the third groove 10, but may be formed on the entire surface of the inner wall surface of the third groove 10. The second piezoelectric substrate 8 is formed of the same material as the first piezoelectric substrate 1 and is, for example, a PZT substrate of 50 mm×50 mm×0.25 mm. As an example, the third groove 9 is of periodic grooves each having a groove length (size in the direction Z) of 50 mm, a groove width of 0.22 mm and a groove depth of 0.15 mm with the grooves being formed at intervals of 0.424 mm between adjoining grooves.

The working of the second piezoelectric substrate 8 is conducted according to the same methods as in the working of the first piezoelectric substrate 1 as described in FIGS. 1A to 1D.

Figure 1F:
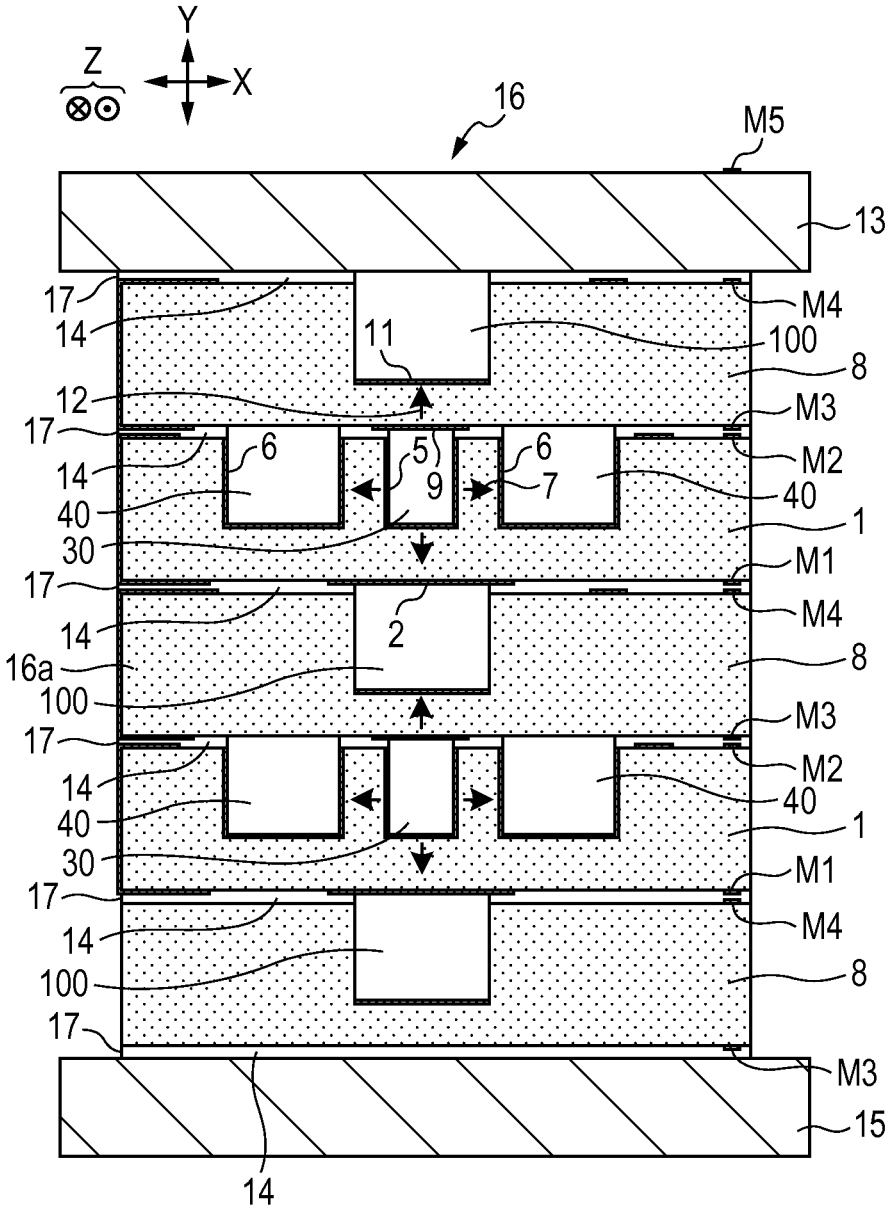

As illustrated in FIG. 1F, the second piezoelectric substrates 8 and the first piezoelectric substrates 1 which have been subjected to the above-described working are then joined alternately up to respective desired layers with respect to a first support substrate 13. Lastly, a second support substrate 15 is joined to the second piezoelectric substrate 8. As a result, a piezoelectric body in which four air chambers 40, 100 have been arranged on both sides of the pressure chamber 30 in a laminating direction (direction Y) and on both sides of the pressure chamber 30 in a direction (direction X) perpendicular to the laminating direction is formed.

Upon the joining, the positions of the respective substrates are determined on the basis of a fifth mark M5 provided on the first support substrate 13 to join them. For example, when the second piezoelectric substrate 8 is joined, the mark M4 on the second piezoelectric substrate 8 is aligned with the mark M5. When the first piezoelectric substrate 1 is joined, the mark M2 on the first piezoelectric substrate 1 is aligned with the mark M5.

The first support substrate 13 favorably has a flexural rigidity higher than the second piezoelectric substrate 8 and first piezoelectric substrate 1 subjected to the grooving. The value of the flexural rigidity of the piezoelectric substrate after the grooving may be the flexural rigidity value of a bottom wall with the lowest flexural rigidity. The flexural rigidity of the bottom wall may be simply calculated from a material constant of the piezoelectric substrate and the shape of the groove.

The first support substrate 13 may be a flat plate. Since the flexural rigidity of the flat plate is determined by a material constant and a thickness of the plate, the flexural rigidity of the first support substrate 13 that is a flat plate can be simply calculated.

The piezoelectric substrates bonded to the first support substrate 13 may be worked and heated together with the first support substrate 13 in some cases in a post step for producing the liquid ejection head. Taking easiness of working in such a step and thermal expansion upon the heating into consideration, the first support substrate 13 is favorably composed of the same material as the piezoelectric substrate.

Thereafter, the second support substrate 15 is bonded so as to sandwich the piezoelectric substrates with the first support substrate 13. The material of the second support substrate 15 conforms to the first support substrate 13. The second support substrate 15 may be made unnecessary in some cases.

The joining of the piezoelectric substrate 1 to the support substrate or the joining between the piezoelectric substrates is conducted through, for example, a bonding layer 14. The bonding layer 14 includes a layer composed of, for example, a thermosetting resin. The thickness of the bonding layer 14 is, for example, 1 to 3 μm. Joint strength at a joining interface is 3 MPa or more. This strength can be simply realized by a commercially available adhesive. For example, the bonding layer 14 is applied on to the second principal surface 1*b* (or 8*b*) of the piezoelectric substrate 1 by a transfer method, and alignment is then made to conduct the joining under pressurizing and heating conditions.

Figure 1G:
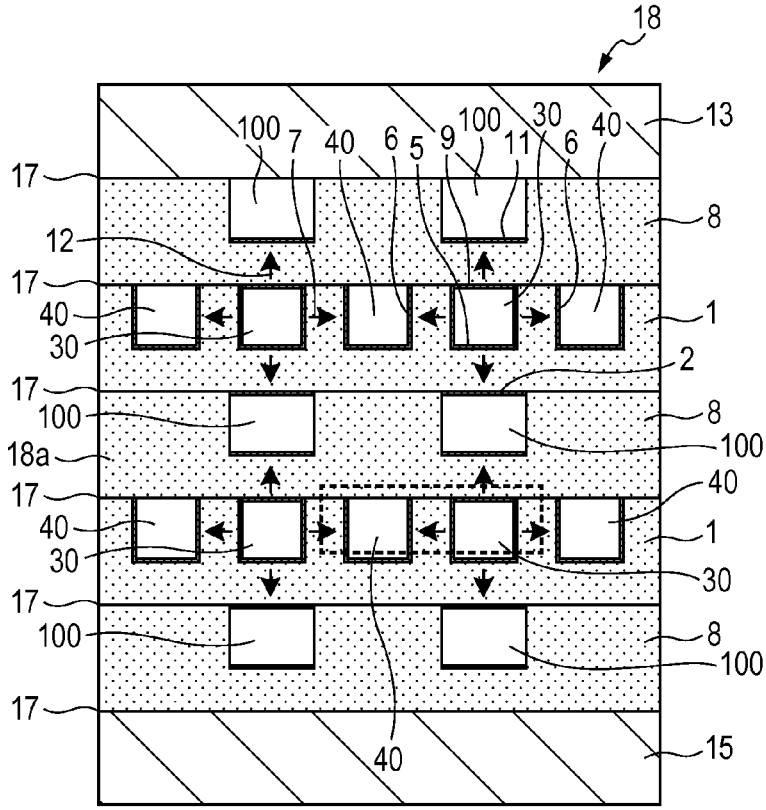

A laminate 16 of the piezoelectric substrates obtained by the joining as described above is divided (not illustrated) as needed. By such dividing, a plurality of piezoelectric bodies 18 each having a desired pressure chamber length and a desired number of pressure chambers can be obtained. FIG. 1G illustrates a lateral surface 18*a* on an ejection orifice side of the piezoelectric body 18 obtained above. The shape of this lateral surface 18*a* is the same as a front surface 16*a* of the laminate 16. The thickness (size in the direction Z) of the piezoelectric body 18, that is, the lengths of the first groove 3, the second groove 4 and the third groove 10 are, for example, 10 mm. In FIG. 1G, the bonding layers are omitted for easy understanding.

In the piezoelectric body 18 illustrated in FIG. 1G, a pressure chamber 30, an air chamber 40 and an air chamber 100 are formed of the first groove 3, the second groove 4 and the third groove 10, respectively. The pressure chamber 30 is provided with an ejection orifice communicating with the pressure chamber 30 for ejecting a liquid and can retain the liquid to be ejected from the ejection orifice. A plurality of the pressure chambers 30 are respectively periodically arranged in a horizontal direction (direction X) and a vertical direction (direction Y). Four air chambers (two air chambers 40 in the direction X and two air chambers 100 in the direction Y) are arranged around each pressure chamber 30. A second electrode 5 and a fourth electrode 9 are formed on an inner wall surface of the pressure chamber 30, and a first electrode 2, a third electrode 6 and a fifth electrode 11 are formed on the inner wall surfaces of the air chambers 40, 100 with the lateral wall, bottom wall or top wall of the pressure chamber 30 therebetween.

The lateral wall, bottom wall and top wall of the pressure chamber 30 are mainly poled in thickness-wise directions (direction X and direction Y) thereof as indicated by arrows 7, 12. The second electrode 5 and fourth electrode 9 present on the inner wall surface of the pressure chamber 30 may be joined to each other to provide an individual electrode. Likewise, the first electrode 2, third electrode 6 and fifth electrode 11 present on the inner wall surfaces of the air chambers 40, 100 may be joined to one another to provide a common electrode. A drive signal (drive voltage) is applied between the individual electrode and the common electrode, whereby a piezoelectric action is caused, the lateral wall, bottom wall and top wall of the pressure chamber 30 are deformed by the piezoelectric action so as to be elongated or contracted, and an ink retained in the pressure chamber 30 can be ejected. This is what is called a Gould type piezoelectric body.

Figure 1H:
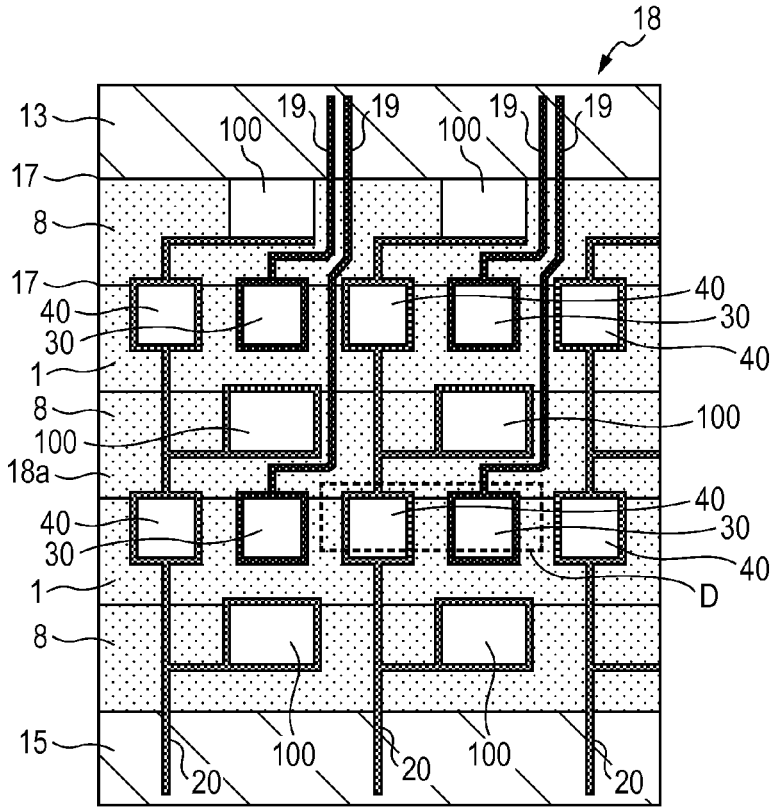

As illustrated in FIG. 1H, electrode wirings 19, 20 each composed of a pattern of a metal thin film are then formed on openings of the pressure chambers 30 and the air chambers 40, 100 and the lateral surface 18*a* of the piezoelectric body 18 having laminating interfaces 17 of the piezoelectric substrates. The pattern of the metal thin film is formed by depositing a metal thin film on the lateral surface 18*a*, the inner wall surface of the pressure chamber 30 and the inner wall surfaces of the air chambers 40, 100 using a pattern of a dry film resist as a mask and then removing the pattern of the dry film resist. As an example, a first wiring electrode 19 connected to the second electrode 5 and fourth electrode 9 present on the inner wall surface of the pressure chamber 30 and a second wiring electrode 20 connected to the first electrode 2, third electrode 6 and fifth electrode 11 present on the inner wall surfaces of the air chambers 40, 100 are formed. FIG. 1H illustrates a planer arrangement and shapes of the wiring electrodes 19, 20.

Figure 2A:
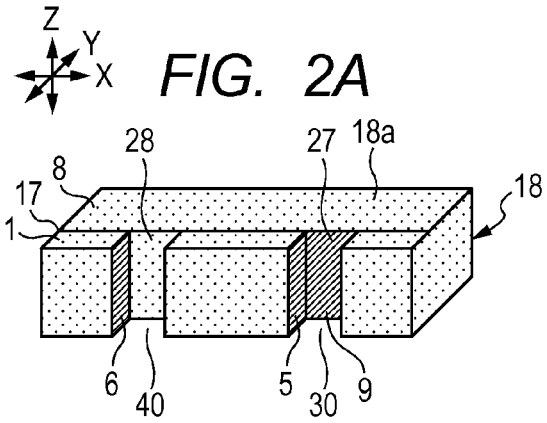
FIGS. 2A, 2B, 2C, 2D, 2E, 2F and 2G illustrate a process for forming a wiring electrode in the first embodiment.

Attention will now be paid to a portion surrounded by the dotted line D in FIG. 1H to explain a process for forming the wiring electrodes 19, 20 with reference to FIGS. 2A to 2G. When a partial perspective view of FIG. 2A is referred, the first piezoelectric substrate 1 and the second piezoelectric substrate 8 are joined through a joining interface 17. A surface of the piezoelectric body 18 on which an ejection orifice is formed becomes a lateral surface 18*a*. The second electrode 5 and the fourth electrode 9 are formed on an inner wall surface of the pressure chamber 30, and the third electrode 6 is formed on an inner wall surfaces of the air chamber 40.

Figure 2B:
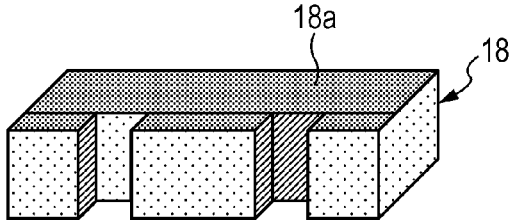

In order to form the wiring electrodes 19, 20, the arithmetic mean roughness Ra of the lateral surface 18*a* of the piezoelectric body 18 is first adjusted as illustrated in FIG. 2B. The arithmetic mean roughness Ra of the lateral surface 18*a* is desirably adjusted to a range of 0.1 μm or more and 1 μm or less from the following reason, and is more desirably adjusted to a range of 0.2 μm or more and 0.5 μm or less. The arithmetic mean roughness Ra is measured according to Japanese Industrial Standard JIS B 0601:2001.

The adjustment of the arithmetic mean roughness Ra can be conducted by using a method of corroding the lateral surface 18*a* with a liquid or a method by mechanical polishing. However, when the liquid is used, it is necessary to protect a substrate surface not intended to be roughened, so that a process becomes complicated. In addition, in the case of a ceramic substrate such as a piezoelectric substrate, the piezoelectric substrate may cause progress of microcracking and falling of crystal grain in some cases. Accordingly, the adjustment of the arithmetic mean roughness Ra is favorably conducted by mechanical polishing.

Figure 2C:
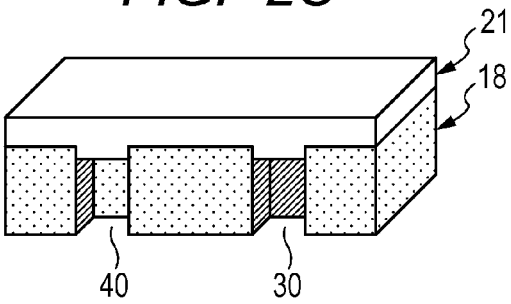

As illustrated in FIG. 2C, a negative dry film resist 21 is then applied on the lateral surface 18*a* (see FIG. 2B) of the piezoelectric body 18 by a vacuum-laminating method. When a lot of voids of the order of several micrometers are present in a PZT surface, development failure is liable to occur on the voids when the dry film resist is too thin. Accordingly, the thickness of the dry film resist is favorably sufficiently larger than the voids, i.e., twice or more as much as an average void diameter. The thickness of the dry film resist is, for example, 40 μm. Since the surface roughness Ra of the lateral surface 18*a* (see FIG. 2B) is adjusted to a range of 0.1 μm or more and 1.0 μm or less, good adhesion is achieved between the lateral surface 18*a* of the piezoelectric body 18 and the dry film resist 21. A part of the dry film resist 21 slightly enters the interiors of the grooves 3, 4.

Figure 2D:
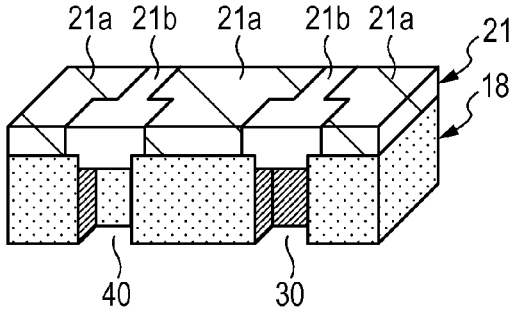

As illustrated in FIG. 2D, the dry film resist 21 is then exposed by photolithography to form an exposed portion 21*a* and an unexposed portion 21*b* in the dry film resist 21. When the surface roughness of PZT is large, there is a small amount of reflected light from the substrate, so that the exposure time is set longer than a case of a smooth surface. For example, the exposure time is favorably 1.5 to 2 times as much as the smooth surface.

Figure 2E:
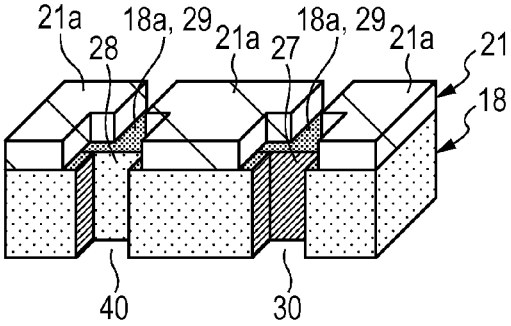

As illustrated in FIG. 2E, the dry film resist 21 is then developed to remove the unexposed portion 21*b* (see FIG. 2D), thereby obtaining a resist pattern 21*a*. A pattern of the dry film resist 21 in which an ejection orifice 27 and an opening 28 as well as a linear region 29 connected to the ejection orifice 27 and the opening 28 are exposed is thereby formed on the lateral surface 18*a* of the piezoelectric body whose surface roughness has been adjusted. At this time, the dry film resist 21 entered in the interiors of the pressure chamber 30 and the air chamber 40 requires a longer development time for removal compared with the resist on a flat portion (see FIG. 1B) of the lateral surface 18*a*. If the surface roughness Ra of the lateral surface 18*a* is less than 0.1 μm, stripping of the resist pattern 21*a* occurs when the development time is long, so that a desired pattern cannot be obtained. If the surface roughness Ra of the lateral surface 18*a* is more than 1.0 μm on the other hand, the residue of the resist may remain on the lateral surface 18*a* after the development in some cases. When the surface roughness Ra of the lateral surface 18*a* falls within a range of 0.1 μm or more and 1.0 μm or less, particularly a range of 0.2 μm or more and 0.5 μm or less, the stripping of the resist pattern 21*a* and the remaining of the resist on the lateral surface 18*a* exposed do not almost occur after the development, so that a desired resist pattern can be obtained.

Figure 2F:
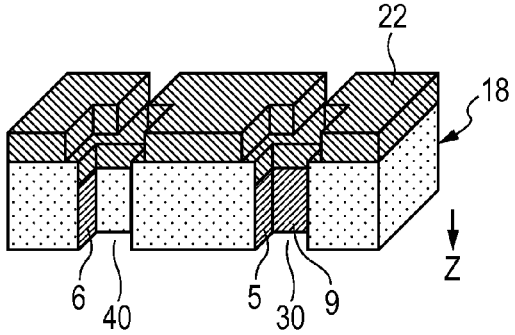

As illustrated in FIG. 2F, a metal thin film 22 is deposited on the lateral surface 18*a* (linear region 29) of the piezoelectric body exposed after the development from a direction (direction Z) parallel to the pressure chamber 30 and the air chamber 40. When an oxygen plasma treatment is conducted prior to the deposition of the metal thin film 22 to remove an organic substance which may be attached on to the lateral surface 18*a*, adhesion between the metal thin film 22 and the lateral surface 18*a* can be more improved. A method for depositing the metal thin film 22 is favorably a sputtering method. The metal thin film 22 is, for example, an Al film having a thickness of 1 μm. The metal thin film 22 may be a laminated film of metal films which is formed by depositing a Cr film having a thickness of 30 nm and an Au film having a thickness of 0.5 μm in that order. Since the metal thin film 22 is deposited by sputtering, the film is deposited not only on the lateral surface 18*a* of the piezoelectric body, but also on the inner wall surfaces of the pressure chamber 30 and the air chamber 40 to a certain depth. The metal thin film 22 deposited on the inner wall surfaces of the pressure chamber 30 and the air chamber 40 is connected to the electrodes 5, 9 on the inner wall surface of the pressure chamber 30 and the electrode 6 on the inner wall surface of the air chamber 40. At the same time, the metal thin film 22 is also deposited on the front surface and the lateral surface (see FIG. 2E) of the resist pattern 21*a*. A pattern of the metal thin film 22 that is connected to the electrodes 5, 9, 6 on the inner wall surfaces and continuously extends from the inner wall surfaces to the linear region 29 is formed by using the pattern of the dry film resist 21 as a mask according to the above-described process.

Figure 2G:
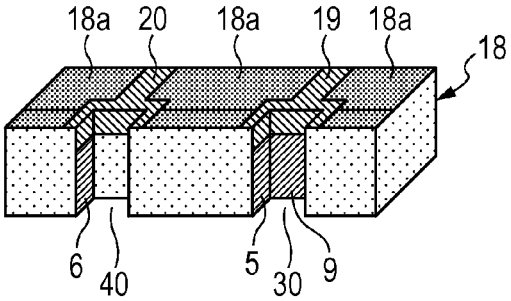

As illustrated in FIG. 2G, the metal thin film 22 deposited on the front surface and lateral surface of the resist pattern 21*a* (see FIG. 2E) is then removed. For example, the resist pattern can be removed with a chemical which dissolves the resist pattern 21*a* (see FIG. 2E). Alternatively, the resist pattern may also be released by using a chemical which swells the resist pattern 21*a* (see FIG. 2E). In this case, when this step is conducted in an ultrasonic bath, the resist pattern can be easily released. With the removal of the resist pattern 21*a* (see FIG. 2E), the metal thin film 22 deposited on the front surface and lateral surface thereof is also removed together. As a result, only the metal thin films directly deposited on the lateral surface 18*a* of the piezoelectric body and the inner wall surfaces of the pressure chamber 30 and the air chamber 40 remain on the piezoelectric body 18 and become wiring electrodes 19, 20.

The process illustrated in FIGS. 2C to 2G is what is called a lift-off process. If a resist residue is present on the surface of the latent surface 18*a* exposed after the development in the lift-off process, a metal thin film on the resist residue is removed together with the resist residue upon the lift-off, so that a defect occurs on the resulting wiring electrode. In this embodiment, since the surface roughness Ra of the lateral surface 18*a* is adjusted to the range of 0.1 μm and more and 1.0 μm or less prior to the lift-off process, the resist residue on the latent surface 18*a* exposed after the development is almost removed, and so the defect of the wiring electrode scarcely occurs.

The metal this film 22 connected to the electrodes 5, 9 on the inner wall surface of the pressure chamber 30 is the first wiring electrode 19 illustrated in FIG. 1H. The metal this film 22 connected to the electrode 6 on the inner wall surface of the air chamber 40 is the second wiring electrode 20 illustrated in FIG. 1H. In this manner, the electrodes 5, 9 on the inner wall surface of the pressure chamber 30 and the electrode 6 on the inner wall surface of the air chamber 40 are drawn out on the lateral surface 18*a* of the piezoelectric body through the wiring electrodes 19, 20, respectively. Although not illustrated in FIGS. 2A to 2G, the electrodes 2, 11 on the inner wall surface of the air chamber 100 formed by the groove are drawn out on the lateral surface 18*a* of the piezoelectric body through the second wiring electrode 20 (see FIG. 1H).

In this embodiment, as illustrated in FIG. 1H, the electrodes on the inner wall surface of each pressure chamber 30 are drawn out as individual electrodes through the wiring electrode 19, and the electrodes on the inner wall surfaces of the air chambers 40, 100 are divided into groups and drawn out for every group through the common wiring electrode 20.

In this embodiment, as illustrated in FIG. 1H, both wiring electrodes 19, 20 are formed on a lateral surface 18*a* on an ejection orifice side of the piezoelectric body. A part or all of the wiring electrodes may also be formed on a lateral surface on an ink supply side opposing the ejection orifice side as needed.

As described above, the surface roughness Ra of the lateral surface is adjusted to the range of 0.1 μm and more and 1.0 μm or less upon the formation of the wiring electrodes on the lateral surface of the piezoelectric body having the ejection orifice and the opening by the lift-off method, whereby the process failure such as stripping of the resist pattern or the defect of the wiring electrode can be reduced.

Second Embodiment

Figure 3A:
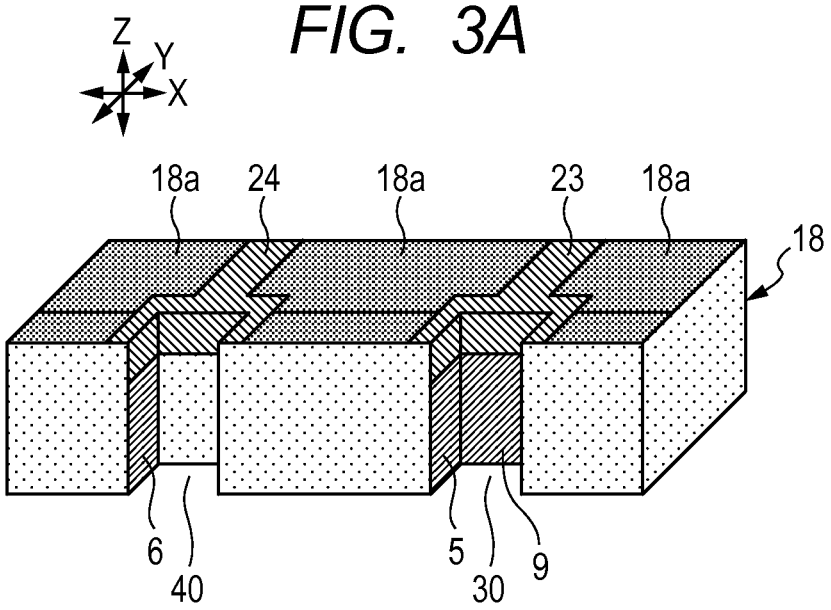
FIGS. 3A and 3B illustrate a process for producing a liquid ejection head according to a second embodiment.
Figure 3B:
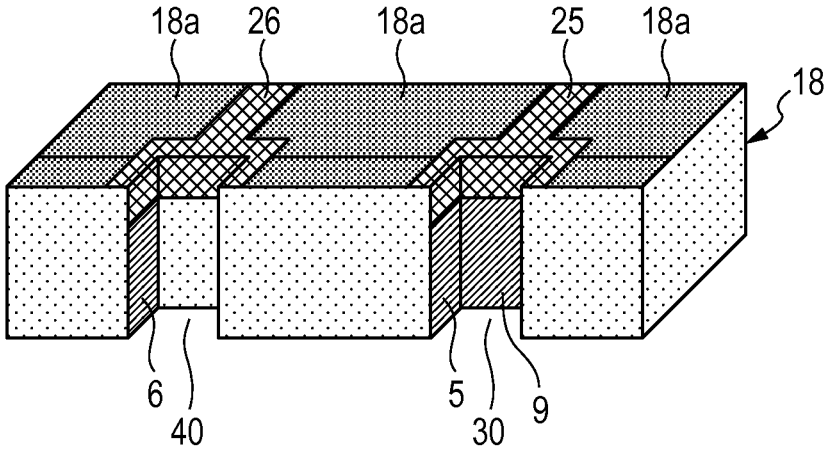

A process for producing a liquid ejection head according to a second embodiment will be described with reference to FIGS. 3A and 3B FIGS. 3A and 3B are partial perspective views illustrating the same portion as that illustrated in FIG. 2G described in the first embodiment. The same signs are given to the same components as those illustrated in FIGS. 1A to 1H and FIGS. 2A to 2G to simply describe them.

In this embodiment, a seed layer is deposited on a lateral surface and on the inner wall surfaces of a pressure chamber and an air chamber using a pattern of a dry film resist 21 as a mask by the lift-off method described in first embodiment. Thereafter, the pattern of the dry film resist 21 is removed, and a metal plating film (wiring electrode) is further formed on the seed layer by a plating method. Details will hereinafter be described.

A piezoelectric body 18 is first provided according to the procedure illustrated in FIGS. 1A to 1G of the first embodiment. Seed layers of wiring electrodes are then formed by the lift-off method according to the procedure illustrated in FIG. 1H and FIGS. 2A to 2G of the first embodiment to provide a piezoelectric body 18 having the seed layers as illustrated in FIG. 3A. FIG. 3A illustrates the same portion as that illustrated in FIG. 2G described in the first embodiment. The seed layers 23, 24 illustrated in FIG. 3A respectively have the same shapes as the wiring electrodes 19, 20 illustrated in FIG. 2G. However, the seed layers 23, 24 are formed with a metal thin film thinner than the wiring electrodes 19, 20. For example, the seed layers 23, 24 are two-layer films with a chromium (Cr) film having a thickness of 20 nm and a palladium (Pd) film having a thickness of 0.1 μm deposited in this order.

As illustrated in FIG. 3B, the seed layers 23, 24 are used as seeds to plate an Ni film having a thickness of about 1 μm and an Au film having a thickness of about 0.1 μm in this order by an electroless plating method, thereby forming plating films 25, 26. Accordingly, the metal plating film is a two-layer film with nickel (Ni) and gold (Au) deposited in this order. As a result, a first wiring electrode corresponding to the wiring electrode 19 in the first embodiment is formed by the seed layer 23 and the plating film 25. A second wiring electrode corresponding to the wiring electrode 20 in the first embodiment is formed by the seed layer 24 and the plating film 26.

In this embodiment, the wiring electrodes are formed by the two stages of the formation of the seed layers and the formation of the plating films as described above. The merits thereof are as follows. First, since the seed layers may be relatively thin, they are more easily lifted off than a thick metal film. In particular, the size and degree of burrs which may be produced in the lift-off step become small as the metal film is thin. As a result, a pattern of the seed layer can be formed with high precision. Second, a relatively thick wiring electrode can be formed by plating. When there is need to lower the resistance of the wiring electrode in particular, a large film thickness can be simply realized by thickening the plating film. If it is attempted to obtain a thick metal film only by the lift-off, there is a possibility that pattern precision may be deteriorated in association with burrs or the like. On the other hand, when a plating film is added on to the thin seed layer, the pattern precision of the wiring electrode is hard to be deteriorated even when the thickness of the plating film is made relatively thick. Third, the plating film is grown in a thickness-wise direction, and at the same time grown even in a lateral direction, so that break or discontinuity of the wiring electrode which may be caused at an interface between piezoelectric substrates can be easily prevented.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-140698, filed Jun. 22, 2012, which is hereby incorporated by reference herein in its entirety.

What is claimed is:

1. A process for producing a liquid ejection head having a piezoelectric body provided with an ejection orifice for ejecting a liquid and a pressure chamber communicating with the ejection orifice for retaining the liquid to be ejected from the ejection orifice, wherein an electrode is formed on an inner wall surface of the pressure chamber so that the pressure chamber is deformed by a piezoelectric action caused by applying a voltage to the electrode, thereby ejecting the liquid, the process comprising the steps of:

providing the piezoelectric body in which a surface thereof on which the ejection orifice is located has a surface roughness within a range of 0.1 μm or more and 1 μm or less in terms of arithmetic mean roughness Ra;

forming a pattern of a dry film resist on the surface of the piezoelectric body so as to expose the ejection orifice and a linear region connected to the ejection orifice; and forming a pattern of a metal thin film that is connected to the electrode on the inner wall surface of the pressure chamber and continuously extends from the inner wall surface of the pressure chamber to the linear region by using the pattern of the dry film resist as a mask.

2. The process according to claim 1, wherein the surface roughness of the surface of the piezoelectric body is adjusted to a range of 0.2 μm or more and 0.5 μm or less in terms of arithmetic mean roughness Ra by mechanical polishing.

3. The process according to claim 1, wherein the pattern of the metal thin film is formed by depositing the metal thin film on the surface of the piezoelectric body and the inner wall surface of the pressure chamber by using the pattern of the dry film resist as the mask and then removing the pattern of the dry film resist.

4. The process according to claim 1, wherein the pattern of the metal thin film is formed by depositing a seed layer on the surface of the piezoelectric body and the inner wall surface of the pressure chamber by using the pattern of the dry film resist as the mask, then removing the pattern of the dry film resist and then depositing a metal plating film on the seed layer.

5. The process according to claim 4, wherein the seed layer is a two-layer film deposited in the order of chromium (Cr) and palladium (Pd) by using a sputtering method, and the metal plating film is a two-layer film deposited in the order of nickel (Ni) and gold (Au).

6. The process according to claim 1, wherein the piezoelectric body is formed by alternately laminating a first piezoelectric substrate in which a first groove and a second groove are alternately formed side by side and a second piezoelectric substrate in which a third groove is formed side by side in such a manner that the pressure chamber is formed by the first groove, and four air chambers are formed by the second and third grooves so as to surround the pressure chamber in a laminating direction of the piezoelectric body and a direction perpendicular to this laminating direction.

* * * * *